US005678274A

United States Patent [19]

Liu

[11] Patent Number: 5,678,274

[45] Date of Patent: Oct. 21, 1997

[54] ANATOMICAL TOOTHBRUSH

[76] Inventor: Ken Tu Liu, 106 N. Cedar St., N. Massapequa, N.Y. 11758

[21] Appl. No.: 597,850

[22] Filed: Feb. 7, 1996

[51] Int. Cl.[6] ..... A46B 9/04

[52] U.S. Cl. ..... 15/167.1; 15/DIG. 5

[58] Field of Search ..... 15/207.2, 167.1, 15/DIG. 5

[56] References Cited

U.S. PATENT DOCUMENTS

| | | | |
|---|---|---|---|
| 1,059,426 | 4/1913 | Barnes | 15/167.1 |
| 2,040,245 | 5/1936 | Crawford | 15/167.1 |
| 3,188,673 | 6/1965 | Newman | 15/167.1 |
| 4,679,273 | 7/1987 | Okin | 15/167.1 |
| 5,305,489 | 4/1994 | Lage | 15/167.1 |
| 5,511,275 | 4/1996 | Volpenhein | 15/DIG. 5 |

FOREIGN PATENT DOCUMENTS

| | | | |
|---|---|---|---|
| 2433956 | 2/1976 | Germany | 15/167.1 |

*Primary Examiner*—David Scherbel
*Assistant Examiner*—Randall Chin
*Attorney, Agent, or Firm*—Niro, Scavone, Haller & Niro

[57] ABSTRACT

An anatomical toothbrush having a configuration for maximizing the brushing effectiveness of the molar and premolar teeth is disclosed. Specifically, the present invention discloses a toothbrush with a bristle face forming a plurality of arcuate curves of various lengths along the longitudinal axis of the toothbrush head in order to conform to the premolar and molar tooth configuration, thus maximizing the brushing of the interproximal tooth surfaces.

1 Claim, 3 Drawing Sheets

ANATOMICAL TOOTHBRUSH

BACKGROUND OF THE INVENTION

The present invention relates to a novel toothbrush for improving oral hygiene. Specifically, the present invention discloses a toothbrush having a unique configuration of bristles on the brush head in order to conform to tooth surfaces so as to maximize the effectiveness of brushing.

Dental caries and periodontal diseases are prevalent in the general population. The etiologic agent of these common human afflictions is microbial plaque. Plaque is a sticky viscous substance held to the tooth surfaces and is composed of bacterial colonies and matrix. Ideally, plaque is removed by mechanical means such as brushing. The disruption of colonization of plaque bacteria to prevent the accumulation of these plaques is the rationale behind tooth brushing. Brushing is essentially the scrubbing of the tooth surfaces with a toothbrush. To be effective, the bristles have to reach the surfaces they are intended to clean. The present invention teaches an anatomically correct toothbrush having the brushing surfaces of its tufts conformed to the tooth surfaces to achieve the maximum plaque removing effect on the interproximal tooth surfaces.

The interproximal spaces present a different kind of challenge to brushing. The spaces between the posterior teeth are wedge-shaped. The toothbrush with bristles of the same length are inaccessible to these spaces. To reach these spaces forcefully with the flat-surface brushes, the bristles in contact with the convex areas of the teeth would be bent in random directions under pressure, thus preventing the bristle face area aimed at the interproximal spaces from reaching these surfaces. As a result, flat surface toothbrushes are unpredictable and ineffective in brushing the interproximal surfaces of the teeth. The anatomically correct toothbrush is contoured to reach the interproximal surfaces of the teeth, thus maximizing the plaque removing effect.

The interproximal spaces are one of the most vulnerable areas to plaque build-up and cavities. It is most challenging to keep the lingual surfaces of the lower posterior teeth clean. These areas are more difficult to clean than the buccal surfaces of the same teeth or the corresponding surfaces of the upper posterior teeth for three reasons:

1. The lower posterior teeth have a five degree inclination toward the lingual side. The long axes of the lower posterior teeth form a less than 180 degree angle with the jaw bone (as shown in the attached FIG. 12);
2. The physical presence of the lower anterior teeth prevents a toothbrush from extending in a perpendicular fashion to lingual surface of the lower posterior teeth. The brush head can only reach these areas at an angle as it is pushed upward in the front by the lower anterior teeth;
3. The lingual contour of the crown of the lower molar is convex in its entirety. The crest of the curvature is located at about the center of the middle third of the crown (as shown in the attached FIG. 13). The gumline is slightly recessed at the crest of the concave contours between lingual surfaces of the molar teeth and gingival tissues.

A brush head with the bristle configuration conformed to the lingual surfaces of the lower posterior teeth is needed to maximize the efficiency of plaques removal in these areas. Since the buccal surfaces are similar in size and shape to the lingual surfaces of a given tooth, a toothbrush adapted to clean the difficult-to-reach lingual areas of the teeth can also adapt to clean the buccal areas of the same teeth. Also, the mesio-distal length of the upper posterior teeth are similar to that of the lower posterior teeth (as is known by reference to manuals in the art, see e.g., *Tooth Carving Manual* by Henry A. Linek, distributed by Columbia Dentoform Corporation). The brush head can accommodate this slight change in dimensions by the flexibility of its bristles.

The posterior teeth in general consists of two molars and two premolars in adults. A brush head with bristle configuration conformed to the curved surfaces of two molars and one premolar could be most effective to clean those three teeth. For persons having a third molar, brushing can be achieved by moving the brush one molar length backward. To brush the first premolar effectively, the brush can be moved one premolar length forward. Therefore, all the lower posterior teeth can be brushed with the anatomically correct toothbrush that is adapted to an ideal fit against those teeth in the middle of the "brushstroke" over the lower posterior teeth. Similarly, the upper posterior teeth can be brushed the same way. Brushing of all the posterior teeth, both upper and lower, can be accomplished with one anatomically correct toothbrush. The individual dimensional variations can be accommodated by having different sizes of the brush heads.

DESCRIPTION OF THE PRIOR ART

Dental plaque is generally considered to be the causative agent of the dental decay and periodontal diseases which are prevalent among the general population. The removal of plaque is the key to the prevention of these diseases. In an effort to clean the teeth, a vast variety of toothbrushes have been designed.

Some references disclose toothbrushes with alternating bristle or tuft lengths. However, such references do not teach the use of alternate bristle length for simultaneously accommodating both the molar and premolar teeth. The alteration of bristle length in these toothbrushes does not coincide with the mesio-distal dimensional changes of the teeth, thus resulting in the ineffective removal of plaque. Moreover, such toothbrushes fail to focus on the need to increase the effectiveness for brushing both molars and premolars.

Other references disclose toothbrushes with spaced groups of bristles. However, these bristle tufts are of equal length. They are difficult to squeeze into the small interproximal spaces they intend to clean. Furthermore, the mechanisms used to adjust the spacing of the bristle groups are cumbersome and random. Making adjustments after brushing of each tooth renders it impractical to use such a toothbrush. The variations in sizes and shapes of different kinds of teeth and among individuals can not be accommodated by the brush.

Still other references disclose spherical and/or elliptical convex profiles for a toothbrush. However, such a toothbrush could not reach the gumline as desired, since the convex profile of the tufts could not reach these areas. The bristles turn away from the gumline rather than aiming at the gumline. Furthermore, the alternating concave and convex bristle tufts which do not follow the contoured surfaces of the teeth result in the random contact of the bristles with the tooth surfaces.

In short, none of the prior art, either alone or in combination, discloses a toothbrush that is adapted to conform to the interproximal spaces of the molars and premolars. Specifically, none of the prior art teaches a toothbrush head having multiple arcs of varying sizes defined in the bristle face so as to conform to the irregular intervals of interproximate spaces between the molars and premolars.

SUMMARY OF THE INVENTION

The present invention includes an anatomical toothbrush having a handle and a toothbrush head. The toothbrush head preferably includes a plurality of bristle tufts arranged in rows having different bristle lengths in order to conform to the lingual surfaces of at least the first molar and second premolar teeth.

Specifically, the present invention calls for a toothbrush having a handle end and a tip end with a brush head attached towards the tip end. The bristles in the brush head form a brush face in which is defined a plurality of substantially arcuate curves along the longitudinal axis of the brush. The molar curve (i.e., the curve farthest from the toothbrush handle) conforms to the lingual or buccal surface of the first molar tooth, and the premolar curve is positioned between the first molar curve and the handle and conforms substantially to the lingual or buccal surface of the second premolar. A preferred embodiment of the present invention calls for yet another curve defined between the molar curve and the tip end, wherein the additional arc conforms substantially to the lingual or buccal surface of the second molar. Thus, this preferred embodiment of the present invention conforms to the interproximal spaces of both the molar and premolar teeth.

Accordingly, an object of this invention is to provide a toothbrush which can reach the interproximal spaces to remove deleterious plaque which can cause periodontal diseases and caries resulting in the loss of the teeth.

A further object of the present invention is to provide a toothbrush that can readily access interproximal spaces that are inaccessible by a flat-surfaced toothbrush, including the interproximal spaces of the molars and premolars of both the upper and lower teeth.

Another object of the present invention is to provide a toothbrush which can reach the gingival marginal areas to remove plaque from these areas to prevent decay and gingivitis with subsequent periodontal diseases. The unique wavy surface top of the bristle tufts can more effectively remove the plaque from the gingival margins.

Still another object of the present invention is to provide a toothbrush to clean tooth surfaces having numerous pits and fissures. The unique surface characteristics of bristle tuft crests could readily access these pits and fissures of the molars and premolars to keep them clean.

Yet another object of the present invention is to provide a toothbrush which can remove the plaque from the anterior teeth, particularly the gingival margins where plaque tends to accumulate.

DESCRIPTION OF THE DRAWINGS

The novel features which are characteristic of the invention are set forth in the appended claims. The invention itself, however, together with further objects and attendant advantages thereof, will be best understood by reference to the following description taken in connection with the accompanying drawings, in which:

DETAILED DESCRIPTION OF THE PREFERRED EMBODIMENT

Figure 1:
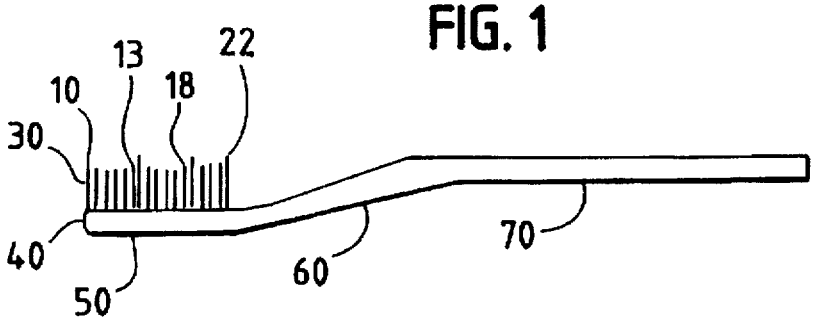
FIG. 1 is the side view of the anatomical toothbrush of the present invention.
Figure 2:
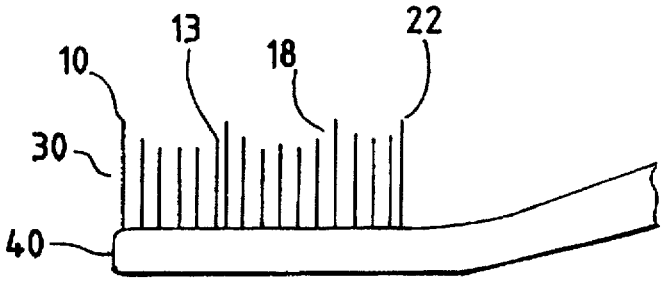
FIG. 2 is the side view of the enlarged brush head.

Referring to FIG. 1, the anatomical toothbrush of the present invention consists of three main elements, the brush head 50, the connecting element 60 and the handle 70, all made of plastic or similar materials. The handle 70 is generally rectangular in shape, and is preferably about 8 mm thick, 11 mm wide and 110 mm long. The connecting element 60 is approximately 6 mm wide, 6 mm thick and 25 mm long and is attached to the brush head 50 at about a 10 degree angle at one end and to the handle 70 at an offset angle of about 10 degree angle at the other. The base portion 40 is approximately parallel to the handle 70. The brush head 50 includes a base portion 40 and bristle tufts 30. The base portion is approximately 35 mm long, 14 mm wide and 5 mm thick, and it defines openings to anchor the bristle tufts 30.

Figure 3:
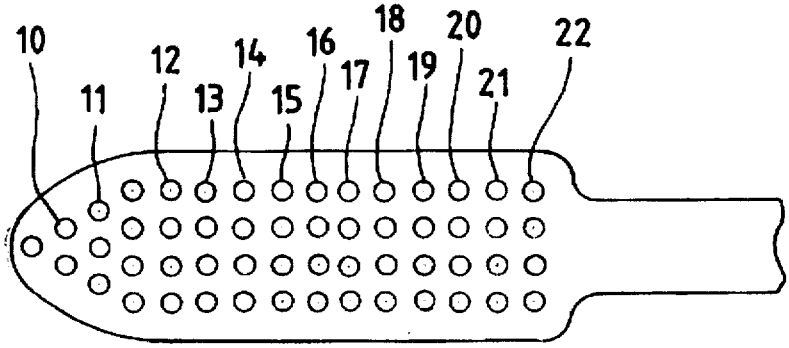
FIG. 3 is the top view of the brush head showing the arrangement of the bristle tufts.

The particular bristle tufts pattern 30 in the embodiment shown in FIG. 3 comprises 12 rows of bristle tufts and tip tufts 10 at the rounded end of the base 40. All the bristle ends are rounded to prevent injury to the gingival tissue and are made of nylon or similar materials. Six tip tufts 10 are arranged in a triangle followed by 12 transverse rows of 4 tufts designated by numerals 11 through 22. The top surface of the bristle tufts are trimmed to form an arc that conforms to the curvatures of the lingual surfaces of the lower second and first molars and second premolar. The six tip tufts 10 and bristle tufts 11 through 13 are trimmed to conform to the lingual surface of the second molar. The bristle tufts 14 through 18 are trimmed to conform to the lingual surface of the first molar. The bristle tufts 19 through 22 are trimmed to conform to the lingual surface of the second premolar.

A preferred embodiment of the present invention focuses on the average mesio-distal dimensions of three lower posterior teeth. The average mesio-distal crown width of the mandibular second molar, first molar and second premolar are 11 millimeters, 11.9 millimeters and 7.8 millimeters, respectively. A brush head with bristle configuration approximately conformed to the lingual surfaces of these three teeth would be most effective in brushing these teeth surfaces.

Of course, those of ordinary skill in the present invention that the curves of the toothbrush of the present invention may vary about 0.5 millimeters from the mesio-distal crown measurements listed above in order to account for varying factors such as manufacturing tolerances.

There is typically a 5 degree inclination of the long axis of the lower posterior teeth to the jaw bone, forming a less than 180 degree angle between the long axis of the lower posterior teeth and the jaw bone, making it more difficult to reach these areas with bristles than the other areas. A toothbrush designed specifically to brush these areas could clean these areas efficiently. The differences in size and shape of the buccal and lingual surfaces both mandibular and maxillary teeth are minor and can be accommodated as the bristles are flexiable. The particular pattern of these tufts allows the bristle filaments direct contact with the tooth surfaces they intend to clean. When this anatomical toothbrush is used in the manner prescribed, the inaccessible interproximal areas for flat-surface toothbrushes become accessible for the removal of the plaque and food debris.

Figure 4:
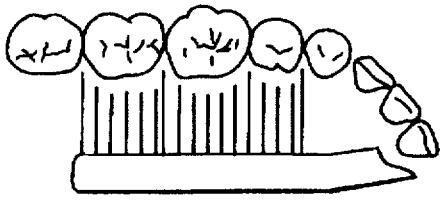
FIG. 4 is the side view of the toothbrush of the present invention in relationship to the lingual surfaces of the lower posterior teeth.
Figure 5:
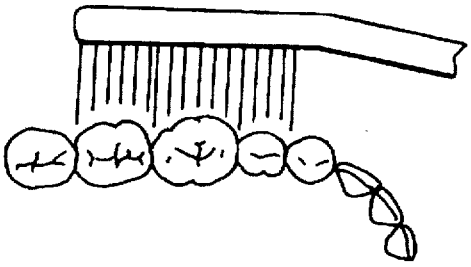
FIG. 5 is the side view of the toothbrush of the present invention in relationship to the buccal surfaces of the lower posterior teeth in normal tooth arrangement.
Figure 6:
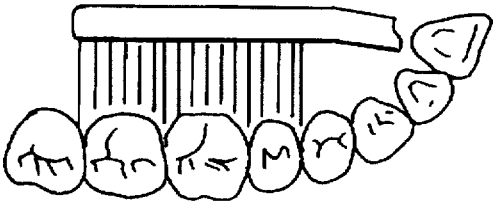
FIG. 6 is the side view of the toothbrush of the present invention in relationship to the lingual surfaces of the upper posterior teeth in normal teeth arrangement.
Figure 7:
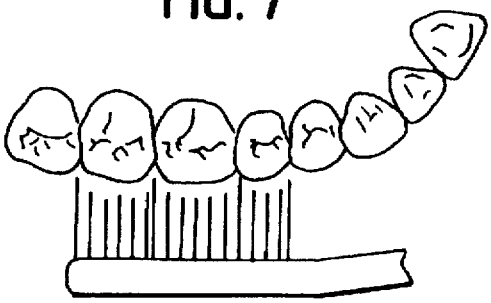
FIG. 7 is the side view of the toothbrush of the present invention in relationship to the buccal surfaces of the upper posterior teeth in normal teeth arrangement.
Figure 8:
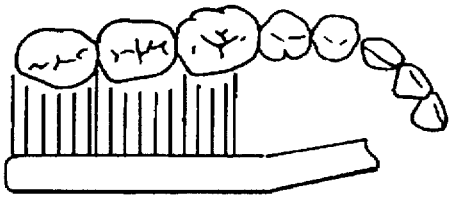
FIG. 8 is the side view of the toothbrush of the present invention in relationship to the lingual surface of the lower third molar.
Figure 9:
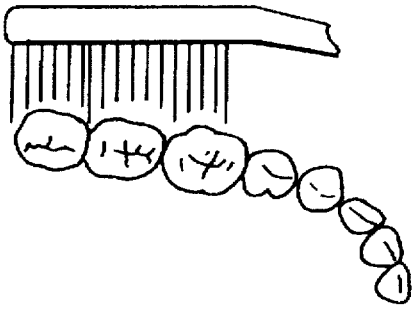
FIG. 9 is the side view of the toothbrush of the present invention in relationship to the buccal surface of the lower third molar.
Figure 10:
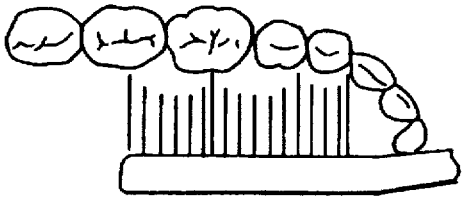
FIG. 10 is the side view of the toothbrush of the present invention in relationship to the lingual surface of the lower first premolar.
Figure 11:
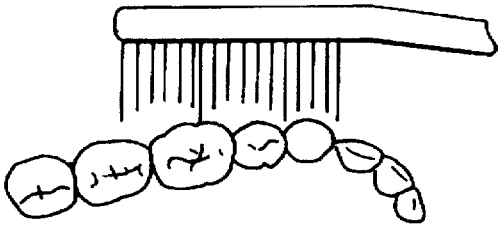
FIG. 11 is the side view of the toothbrush of the present invention in relationship to the buccal surface of the lower first premolar.
Figure 12:
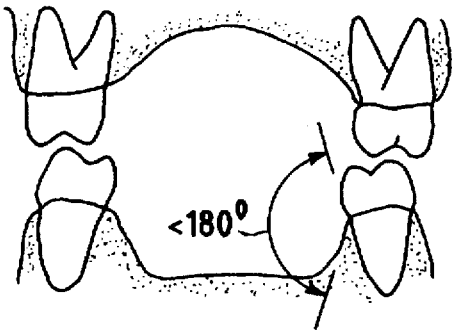
FIG. 12 is the cross sectional view of the lower first molar showing the 5 degree inclination of the long axis of the tooth to the jaw bone.
Figure 13:
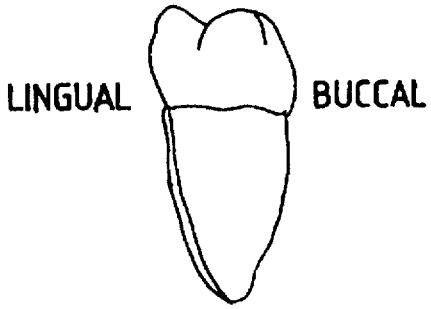
FIG. 13 is the mesial view of the mandibular left first molar showing the convex outline of the lingual surface.

FIG. 4 illustrates the relationship of the anatomical toothbrush of the present invention to the lingual surfaces of the three lower posterior teeth for which the brush is primarily designed to fit. The same toothbrush can fit the buccal surfaces of these three teeth as shown in FIG. 5. Similarly, the adaptability of the arcuate bristle profile to the upper lingual and buccal surfaces in shown in FIGS. 6 and 7. The bristle can effectively engage the interproximal surfaces of these teeth. For effective brushing of the third molar the toothbrush is moved one tooth length backward. The relationship of the brush to the third molar illustrated in FIGS. 8 and 9. The relationship of this anatomical toothbrush to the first premolar is illustrated in FIGS. 10 and 11. Therefore the lingual and buccal surfaces of the posterior teeth, both upper and lower, can be cleaned with the anatomical toothbrush of the present invention to remove the deleterious plaque from the tooth surfaces.

Figure 14:
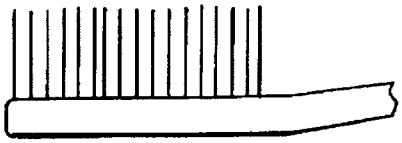
FIG. 14 PRIOR ART
FIG. 14 is the side view of a prior art flat-surface toothbrush in relationship to the teeth in normal arrangement.
Figure 15:
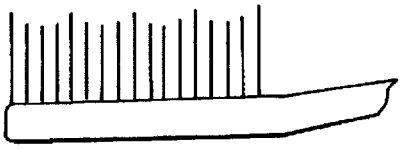
FIG. 15 PRIOR ART
FIG. 15 is the side view of a prior art toothbrush with staggered tufts in relationship to the teeth in normal arrangement.

FIG. 14 illustrates the inaccessibility of prior art flat-surface toothbrushes to the interproximal surfaces of the teeth. For the brush with the bristle filaments of equal length to reach the wedge-shaped interproximal surfaces, other parts of the bristle would have been bent out of shape, resulting in ineffective brushing of these difficult to reach areas. By the same token, alternate bristle length without conforming to the mesio-distal dimensional change from molar to premolar, or vice versa, would result in the unpredictable cleaning effect, as shown in FIG. 15. The brushing would result in random cleaning of interproximal surfaces.

Figure 16:
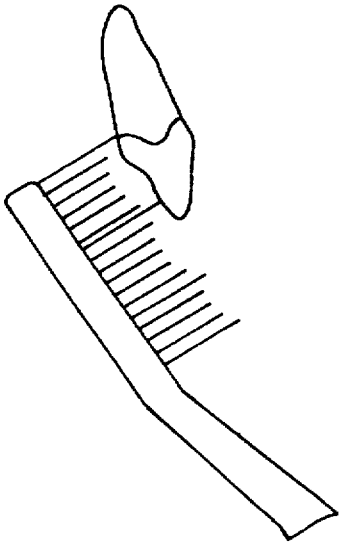
FIG. 16 is the sagittal view of the toothbrush of the present invention in relationship to the lingual surface of an upper anterior tooth

The brush tip tufts 10 include six closely arranged bristle tufts and are shaped in such a way that when the toothbrush is held parallel to the long axes of the front teeth, the bristle filament could easily reach the cervical areas of the teeth to be brushed. FIG. 16 illustrates the approximate relationship between the upper front teeth and the rounded end of brush head of the anatomical toothbrush of the present invention. Upper and lower anterior teeth could be brushed clean the same way.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore, intended that all such changes and modifications be covered by the following claims.

What is claimed is:

1. An anatomical toothbrush comprising a handle and a toothbrush head having a longitudinal axis, said toothbrush head substantially conforming to the lingual surfaces of the molar and second premolar teeth, said toothbrush head comprising:

a. a plurality of bristles, each of said bristles having a fixed end and a free end, said fixed ends being connected to said toothbrush head, and said free ends of said bristles disposed so as to form a bristle face;

b. a plurality of substantially arcuate curves defined in said bristle face along the longitudinal axis of said toothbrush head, said curves including a first curve furthest from the handle, a second curve between said first curve and said handle, and a third curve between said second curve and said handle, said first curve substantially conforming to the lingual or buccal surface of a second molar tooth and extending approximately 11 millimeters along the length of said toothbrush head, said second curve substantially conforms to the lingual or buccal surface of a first molar tooth and extending approximately 11.9 millimeters along the length of said toothbrush head, and said third curve conforming substantially to the lingual or buccal surface of a second premolar tooth, and extending approximately 8 millimeters along the length of said toothbrush head.

* * * * *